US011318366B2

(12) United States Patent
Lindeman

(10) Patent No.: US 11,318,366 B2
(45) Date of Patent: May 3, 2022

(54) APPARATUS FOR CLEANING BELTS OF BOWLING PINSETTER

(71) Applicant: Finems Oy, Sotkamo (FI)

(72) Inventor: Marko Lindeman, Sotkamo (FI)

(73) Assignee: FINEMS OY, Sotkamo (FI)

( * ) Notice: Subject to any disclaimer, the term of this patent is extended or adjusted under 35 U.S.C. 154(b) by 0 days.

(21) Appl. No.: 16/429,438

(22) Filed: Jun. 3, 2019

(65) Prior Publication Data

US 2019/0366195 A1 Dec. 5, 2019

(30) Foreign Application Priority Data

Jun. 5, 2018 (FI) ..... 20185509

(51) Int. Cl.

| | |
|---|---|
| ***A63D 5/10*** | (2006.01) |
| ***A63D 5/08*** | (2006.01) |
| ***B08B 1/00*** | (2006.01) |
| ***B08B 1/02*** | (2006.01) |
| ***B08B 1/04*** | (2006.01) |

(52) U.S. Cl.

CPC ..... *A63D 5/10* (2013.01); *A63D 5/08* (2013.01); *B08B 1/008* (2013.01); *B08B 1/02* (2013.01); *B08B 1/04* (2013.01)

(58) Field of Classification Search

CPC ..... A63D 5/08; A63D 5/10
USPC ..... 473/73
See application file for complete search history.

(56) References Cited

U.S. PATENT DOCUMENTS

| | | | | | |
|---|---|---|---|---|---|
| 1,720,137 | A | * | 7/1929 | Lunn | F16H 55/38 474/92 |
| 2,545,882 | A | * | 3/1951 | Hall | B65G 45/12 198/499 |
| 2,681,137 | A | * | 6/1954 | Davis | B65G 45/12 198/494 |
| 2,960,337 | A | | 11/1960 | Johnson | |
| 3,047,133 | A | * | 7/1962 | Searles | B65G 39/073 198/498 |
| 3,064,974 | A | | 11/1962 | Staley | |
| 3,076,651 | A | | 2/1963 | Hicks | |
| 3,212,631 | A | * | 10/1965 | Thompson | B65G 45/18 198/496 |
| 3,358,813 | A | | 12/1967 | Kohlhagen et al. | |
| 3,794,321 | A | | 2/1974 | Goldstein et al. | |
| 4,189,046 | A | * | 2/1980 | Ward | B65G 45/16 15/256.5 |

(Continued)

OTHER PUBLICATIONS

Search Report issued in EP Appln. No. 19 17 7563 dated Sep. 10, 2019.

(Continued)

*Primary Examiner* — William M Pierce
(74) *Attorney, Agent, or Firm* — Nixon & Vanderhye PC

(57) ABSTRACT

An apparatus for cleaning belts of a bowling pinsetter comprising at least one cleaning member for cleaning at least one belt of the bowling pinsetter and a frame for coupling the at least one cleaning member to the bowling pinsetter. The apparatus further comprises at least one positioning member comprising a mechanism for moving and guiding the at least one cleaning member between a cleaning position and a non-cleaning position, wherein the cleaning member is coupled with the bowling pinsetter in the cleaning position and in the non-cleaning position.

13 Claims, 7 Drawing Sheets

(56) References Cited

U.S. PATENT DOCUMENTS

| | | | | | |
|---|---|---|---|---|---|
| 4,192,034 | A | | 3/1980 | Knepper, Jr. | |
| 4,402,394 | A | * | 9/1983 | Stoll | B65G 45/16 198/499 |
| 4,410,177 | A | | 10/1983 | Richardson | |
| 4,720,939 | A | * | 1/1988 | Simpson | B24B 53/10 451/5 |
| 4,813,673 | A | | 3/1989 | Schmid | |
| 4,852,209 | A | * | 8/1989 | Svenka | B21B 28/04 15/308 |
| 5,372,551 | A | | 12/1994 | McCarthy et al. | |
| 5,437,760 | A | * | 8/1995 | Benkowski | B05C 1/0834 118/203 |
| 5,484,323 | A | * | 1/1996 | Smith | B24B 53/10 451/10 |
| 5,622,249 | A | * | 4/1997 | Morin | B65G 45/12 15/256.6 |
| 6,321,586 | B1 | * | 11/2001 | Wojtowicz | G01N 3/56 73/9 |
| 6,820,734 | B1 | * | 11/2004 | Gilbert | B65G 45/16 198/499 |

OTHER PUBLICATIONS

Search Report for Finnish Patent Application No. 20185509 dated Dec. 10, 2018, 1 page.

* cited by examiner

APPARATUS FOR CLEANING BELTS OF BOWLING PINSETTER

This application claims priority to FI 20185509 filed Jun. 5, 2018, the entire contents of which is hereby incorporated by reference.

FIELD OF THE INVENTION

The invention relates to a bowling pinsetter, and more particularly to a solution for cleaning belts of the bowling pinsetter.

BACKGROUND OF THE INVENTION

The bowling pinsetter comprises a plurality of round belts, which are used for transporting, for example, bowling balls and pins. The belts get dirty during the operation of the bowling pinsetter because, for example, oil, grease and dust gathers on the belts. Cleaning of the belts must be performed regularly to ensure proper operation of the bowling pinsetter. The cleaning of the belts is normally a manual process performed often by a cloth. The belts are cleaned normally one by one when the bowling pinsetter is running. There are many disadvantages in the manual cleaning of the belts. The one bowling pinsetter comprises a plurality of the belts which must be cleaned regularly and there might be, for example, dozens of bowling pinsetters in a bowling alley. Therefore, it is very time consuming to manually clean the belts one by one with the cloth. The manual cleaning process may also be dangerous because of the running bowling pinsetter.

To alleviate the disadvantages described above a more sophisticated solution is needed.

BRIEF DESCRIPTION OF THE INVENTION

The invention is defined by the independent claim.

Embodiments of the invention are defined in the dependent claims.

According to an aspect, an apparatus comprising: at least one cleaning member for cleaning at least one belt of a bowling pinsetter; a frame for coupling the at least one cleaning member to the bowling pinsetter; and at least one positioning member comprising a mechanism for moving and guiding the at least one cleaning member between a cleaning position and a non-cleaning position, wherein the cleaning member is coupled with the bowling pinsetter in the cleaning position and in the non-cleaning position.

In an embodiment, the positioning member is configured to provide a translational and/or a rotational movement for moving and guiding the at least one cleaning member between the cleaning position and the non-cleaning position.

In an embodiment, the frame comprises a housing for the at least one cleaning member and wherein a structure of the housing is open so that the at least one cleaning member contacts the at least one belt of the bowling pinsetter in the cleaning position.

In an embodiment, the frame comprises a first and a second axle for the at least one cleaning member.

In an embodiment, the at least one of the first and the second axle comprises at least one locking member for locking the at least one cleaning member to the at least one of the first and the second axle.

In an embodiment, the first and the second axle is detachably mounted into the frame for replacement of the at least one cleaning member.

In an embodiment, the at least one cleaning member comprises a plurality of the cleaning members mounted into the same axle adjacent to each other.

In an embodiment, the frame comprises a support member for receiving the at least one cleaning member and the at least one belt in the cleaning position.

In an embodiment, the support member is rotatable over its longitudinal axle between a first state and a second state, wherein in the first state the cleaning member is in the non-cleaning position and in the second state the cleaning member is in the cleaning position.

In an embodiment, the support member comprises at least one groove for receiving the at least one cleaning member and the at least one belt in the cleaning position wherein the groove is dimensioned such that the at least one cleaning member cleans the at least one belt from multiple directions.

In an embodiment, the frame comprises a control member for limiting rotation of the first axle.

In an embodiment, the at least one positioning member comprises a mechanism for rotating the first axle during the positioning of the at least one cleaning member to the non-cleaning position and for rotating the second axle during the positioning of the at least one cleaning member to the cleaning position.

In an embodiment, the apparatus comprises a plurality of the cleaning members for cleaning a plurality of the belts of the bowling pinsetter simultaneously.

In an embodiment, the apparatus is an auxiliary device for the bowling pinsetter.

In an embodiment, the apparatus is the bowling pinsetter.

BRIEF DESCRIPTION OF THE DRAWINGS

In the following the invention will be described in greater detail by means of preferred embodiments with reference to the attached drawings, in which.

DETAILED DESCRIPTION OF THE INVENTION

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Figure 1A:
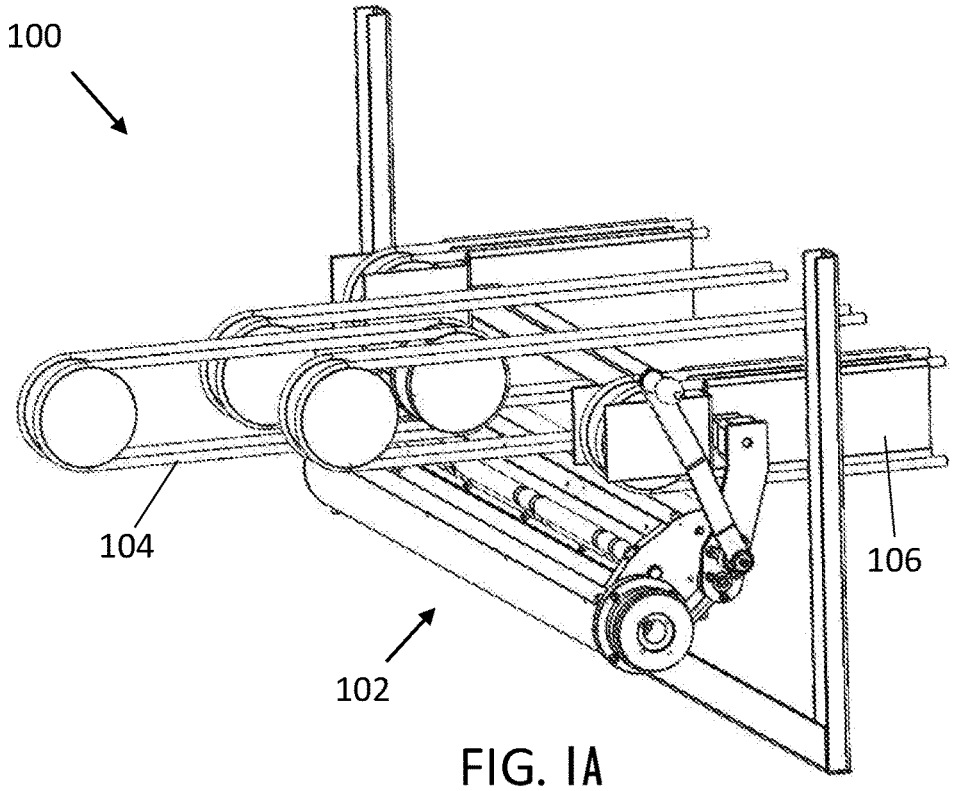
FIG. 1A illustrates an apparatus in a non-cleaning position.
Figure 1B:
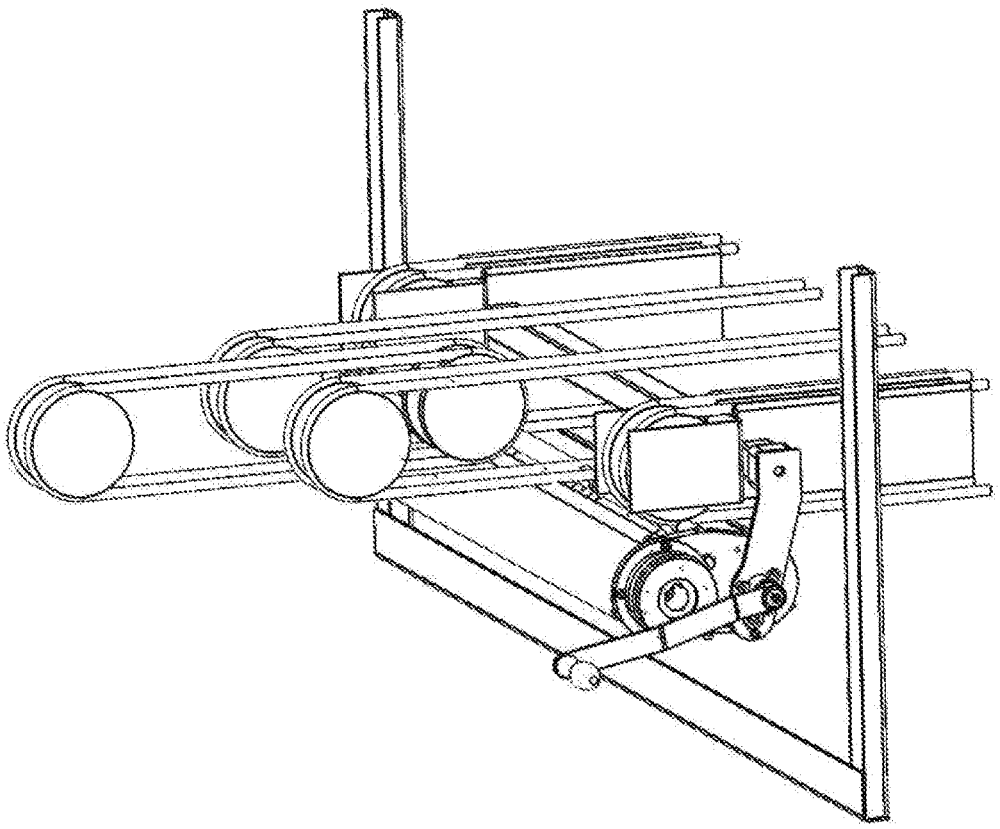
FIG. 1B illustrates the apparatus in a cleaning position.

FIGS. 1A and 1B illustrates an embodiment of an apparatus comprising a bowling pinsetter 100 and an auxiliary device for the bowling pinsetter 102. The auxiliary device is a belt cleaner for cleaning round belts 104 of the bowling pinsetter. The round belt rotates around belt rollers and a cross-sectional profile of the round belt may vary according to the needs. The round belt is used for transporting objects, for example, pins and/or balls in the bowling pinsetter during operation. The belt cleaner may be assembled to a body of the bowling pinsetter 106, for example, under the belts. There may be two different positions for the belt cleaner when it is assembled to the body of the bowling pinsetter, including a cleaning position and a non-cleaning position. When the belt cleaner is assembled under the belts it does not prevent the transportation of objects, hence it does not disturb a normal operation of the bowling pinsetter in the cleaning or the non-cleaning position.

FIG. 1A illustrates the belt cleaner when it is assembled to the body of the bowling pinsetter and the belt cleaner is in the non-cleaning position. In the non-cleaning position the belt cleaner does not contact the belts of the bowling pinsetter and therefore it does not clean the belts although it is still assembled in the body of the bowling pinsetter. The belt cleaner is normally used, for example, once or twice per week for cleaning the belts depending on use the bowling pinsetter. Therefore, most of the time the belt cleaner is in the non-cleaning position. As described above, the belt cleaner does not disturb the normal operation of the bowling pinsetter in the non-cleaning position and therefore removal of the belt cleaner from the body of the bowling pinsetter is not needed when the belt cleaner is not used by the virtue of the non-cleaning position.

FIG. 1B illustrates the belt cleaner when it is assembled to the body of the bowling pinsetter and the belt cleaner is in the cleaning position. When the belt cleaner is positioned to the cleaning position, the belt cleaner contacts the belts of the bowling pinsetter and cleans the belts from a dirt. The dirt that normally gathers on the belts during the operation of the bowling pinsetter is, for example, grease, oil and dust. The dirt must be removed from the belts on a regular basis, otherwise the dirt may affect the operation of the bowling pinsetter. When the belt gets dirty a friction between the belt and the objects that are transported by the belt reduces and, therefore, the belt may not transport the objects properly. This may lead to a situation wherein, for example, the pins start to pile up on the belts and finally the whole bowling pinsetter may be out of function. In this kind of situations, an operator must check the situation in the bowling pinsetter and try to repair the issue caused by the piling up of the pins. During the repairing operation, the bowling pinsetter may not be used at all and hence bowling in a lane of the bowling pinsetter may have to be suspended for the time of repairing. This issue binds resources of the bowling alley and also degrade customer service.

Figure 2:
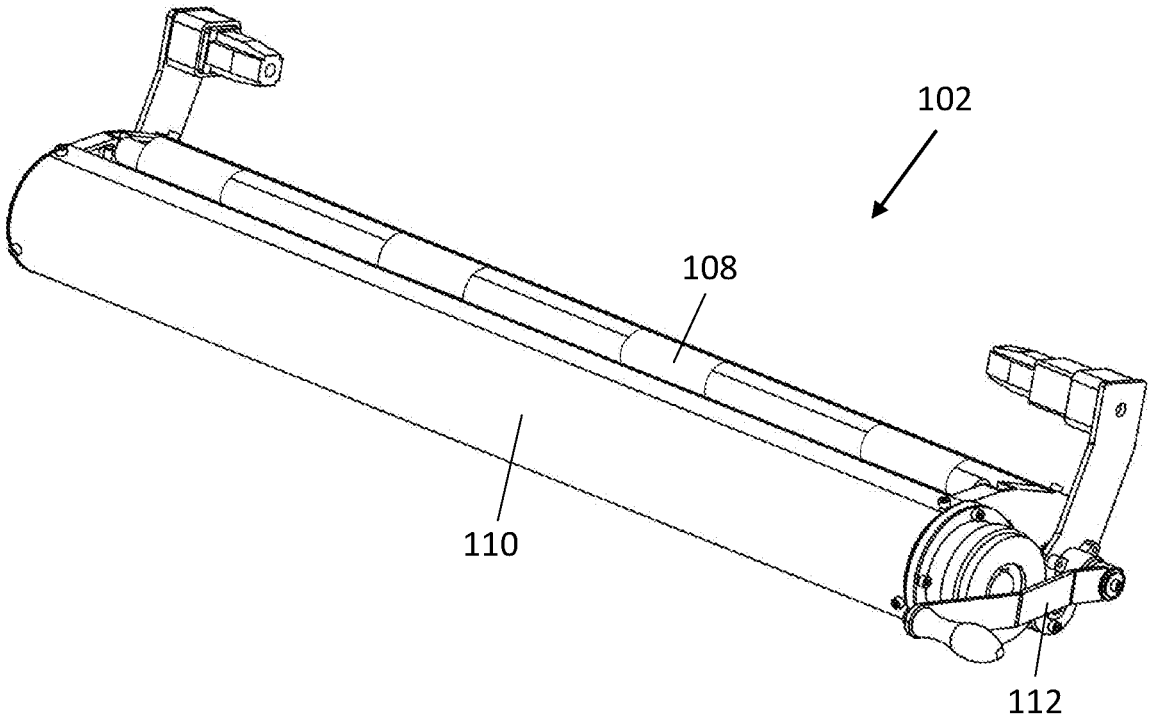
FIG. 2 illustrates an embodiment of a belt cleaner.

FIG. 2 illustrates an embodiment of a main structure of the belt cleaner 102 when it is not assembled in the body of the bowling pinsetter 100. The belt cleaner may comprise at least one cleaning member (108) for cleaning at least one belt of a bowling pinsetter (104), a frame (110) for coupling the at least one cleaning member (108) to the bowling pinsetter (100), at least one positioning member (112) comprising a mechanism for moving and guiding the at least one cleaning member (108) between a cleaning position and a non-cleaning position, wherein the cleaning member (108) is coupled with the bowling pinsetter (100) in the cleaning position and in the non-cleaning position.

In an embodiment, the positioning member (112) is configured to provide a translational and/or a rotational movement for moving and guiding the at least one cleaning member (108) between the cleaning position and the non-cleaning position. In an embodiment, the positioning member may provide the translational movement that moves and guides the cleaning member between the cleaning and non-cleaning positions. For example, the positioning member may move some component from one location to another and the movement of the component moves and guides the cleaning member. The component may be a part of the positioning member or it may be a separate component moved by the positioning member.

In another embodiment, the positioning member may provide the rotational movement that moves and guides the cleaning member between the cleaning and non-cleaning positions. For example, the positioning member may rotate some component such that the rotation moves and guides the cleaning member. The rotational movement may not necessarily change the location of the component like in the translational movement.

In some case, both the translational and rotational movement may be used for moving and guiding the cleaning member between the cleaning and non-cleaning positions. For example, the rotational movement of the positioning member may cause the translational movement of the cleaning member.

Figure 3:
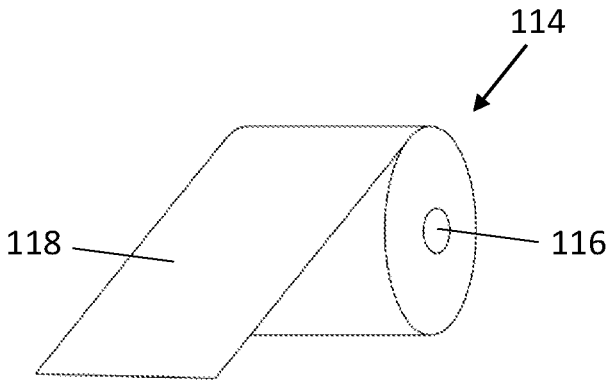
FIG. 3 illustrates an embodiment of at least one cleaning member.

FIG. 3 illustrates an embodiment of the at least one cleaning member. The at least one cleaning member 108 may be, for example, a cloth roll 114. The cloth roll comprise a core 116 and the cleaning cloth 118, which is rolled around the core as a certain size of the roll. The cleaning cloth may be unrolled from the roll when new and clean piece of cloth is needed for cleaning the belts of the bowling pinsetter. Size of the cloth rolls used in the belt cleaner may vary according to the needs. Especially a width of the cloth roll may be chosen according to the purpose of use. In some embodiments, the wider cloth roll may be chosen if the belt cleaner is used for cleaning wider belts. Also, for example, a diameter, material, type of the cloth roll and thickness of the cloth in the roll may vary according to the purpose of the use. In some other embodiments, the at least one cleaning member may be, for example, a brush or some other cleaning element which may be used for removing the dirt from the belt. In some embodiments, a fluid sprayed to the belt may be used as a cleaning member or a combination of the fluid spraying and other cleaning member like, for example, the cloth or the brush. It may also be possible that there is no need to move the at least one cleaning member to the cleaning or the non-cleaning positions. Then at least one cleaning member remains in the same position and is still able to clean the at least one belt of the bowling pinsetter. This may not affect the normal operation of the bowling pinsetter and therefore, there is no need to suspend using of the bowling pinsetter during the cleaning process. For example, if the spraying is used for cleaning, location of the spraying member may remain same all the time and the spraying member is just turned on or off to spray the fluid and clean the belts according to the need.

Figure 4A:
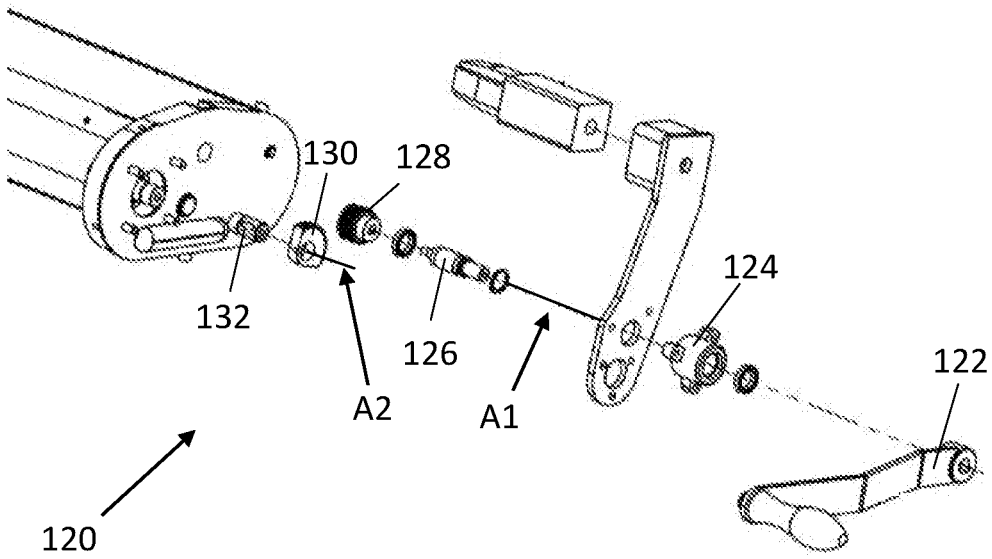
FIGS. 4A and 4B illustrate embodiments of a positioning member.
Figure 4B:
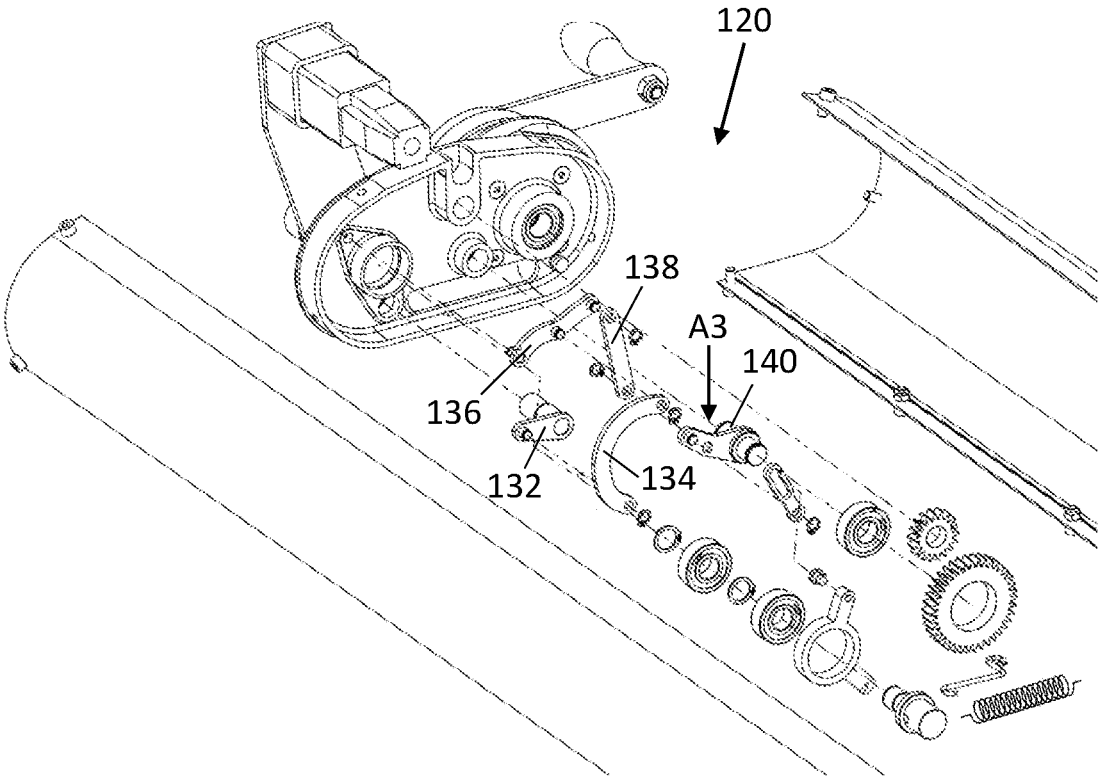

FIG. 4A and 4B illustrate an embodiment of the at least one positioning member 112. The at least one positioning member may comprise a mechanism 120 for providing the needed force to move the at least one cleaning member to the cleaning and/or the non-cleaning position and for guiding the cleaning member to the appropriate position. The mechanism may ensure that the at least one cleaning member is positioned properly relative to the belts in the cleaning position and hence, there is proper contact between the at least one cleaning member and the belt. The proper contact ensures that the belts are cleaned properly. In one embodiment, there may be a separate guiding member for guiding the cleaning member to the appropriate position.

The mechanism may be manual or automatic. The manual mechanism may be, for example, a system wherein the movement force is provided by a handle used by an operator who is operating the belt cleaner. The force is provided by the operator and hence, the mechanism is hand-operated, in other words manual. In some embodiments, the manual mechanism may comprise a handle 122, a base for the handle 124, a connection axle 126 connected to the handle, a first cogwheel 128 connected to the connection axle, a gear rim 130 which contacts with the first cogwheel and an actuator 132. The actuator transmits the movement force to all component that are moving during the operation of the bowling pinsetter. The handle 122 may be connected to a first end of the connection axle 126, for example, by nut or so other suitable locking element. The connection axle goes through the handle base 124 and there may be a thread in the first end of the connection axle for the nut. In a second end of the axle, the first cogwheel 128 is assembled. The gear rim 130 is assembled to a first end of the actuator 312, the first cogwheel 128 and the gear rim 130 are assembled so that their gear tooth contact and hence the first cogwheel may move the gear rim. When the handle 122 is turned, it rotates the connection axle 126 about its longitudinal axle A1. The connection axle 126 is connected with the first cogwheel 128 and hence the first cogwheel rotates with the connection axle and rotation of the first cogwheel rotates the gear rim 130. The gear rim has a hole and the gear rim rotates about the middle axle of the hole. The gear rim 130 is connected with the actuator part 132 and hence the rotation of the gear rim rotates the actuator part about its longitudinal axle A2 of a body. The actuator part 132 may comprise an axle-like body and a first end of the body is connected into the hole of the gear rim. The actuator may comprise an arm in a second end of the body, which is an opposite end to the end, which is connected into the hole of the gear rim. The actuator part goes through the frame 110 and transmits the movement force for all components used for operating the belt cleaner. The arm side end of the actuator is inside the frame and is used for connecting the actuator part with other parts inside the frame and hence for delivering the movement force for the inner components.

The mechanism may further comprise a first actuating part 134, a second actuating part 136, a third actuating part 138 and a fourth actuating part 140. The first actuating part 134 is connected to the arm of the actuator 132 from a first end and to middle of the second actuating part 136 from a second end. The second actuating part is connected to the frame 110 from a first end and to the third actuating part 138 from a second end. The second actuating part is connected to the first end of the third actuating part and the third actuating part is connected from a second end to the fourth actuating part 140. The fourth actuating part may comprise an axle-like body and an arm, which is substantially in the middle of the body. The third actuating part 138 is connected to the arm the fourth actuating part 140. The fourth actuating part is connected also to the frame 110 of the bowling pinsetter from other end of the axle-like body. When the third actuating 138 part transmits the movement to the fourth actuating part 140 via the arm of the fourth actuating part, the fourth actuating part rotates about a longitudinal axle A3 of its body. The movement force for all four actuating part, is provided by the actuator 132, and the movement of these actuating parts move the at least one cleaning member to the cleaning and/or non-cleaning position.

In one embodiment, the mechanism may be automated so that the mechanism itself provides the movement force. For example, the mechanism may comprise an electric motor for providing the needed movement force. The electric motor may be positioned outside or inside of the frame of the belt cleaner. In one embodiment, only the handle may be replaced by the electric motor while all other components of the mechanism may remain same. Then, the electric motor provides the needed movement force and components of the mechanism move the at least one cleaning member to the cleaning or non-cleaning positions. With the automated mechanism, the operator of the belt cleaner may use a switch or button comprised in the belt cleaner, to control the electric motor of the mechanism.

It is also possible that the control of the electric motor of the mechanism is integrated into a control interface of the whole bowling pinsetter. Then, the remote control of the belt cleaner may be possible and operator does not need to enter a room wherein the bowling pinsetter and the belt cleaner are to turn on the belt cleaner. This is a great advantage in the large bowling alleys where may be numerous of the bowling pinsetters in use. In some other embodiments, it is also possible that the mechanism is automated so that when the bowling pinsetter is running, the belt cleaner automatically moves to the cleaning or the non-cleaning position between some predetermined time limit, for example once or twice per week. For example, electronic controllers may be used to determine when the belt cleaner may be positioned to the cleaning and/or the non-cleaning positions. Then a separate turning on or off command for the belt cleaner is not needed. In some other embodiments, positioning of the belt cleaner into the cleaning or the non-cleaning position may be based on the use of the bowling pinsetter. In other words, the cleaning of the belts by the belt cleaner may be automatically determined according to the actual use. Therefore, the cleaning of the belts may be performed after some predetermined operating hours of the bowling pinsetter. Not, for example, once per week if the bowling pinsetter is not much used and some certain predetermined operating time is not achieved. In the embodiment wherein the handle needs to be replaced by the electric motor while other components may remain same, it is easy to update the belt cleaner from manual to the automated system.

Figure 5:
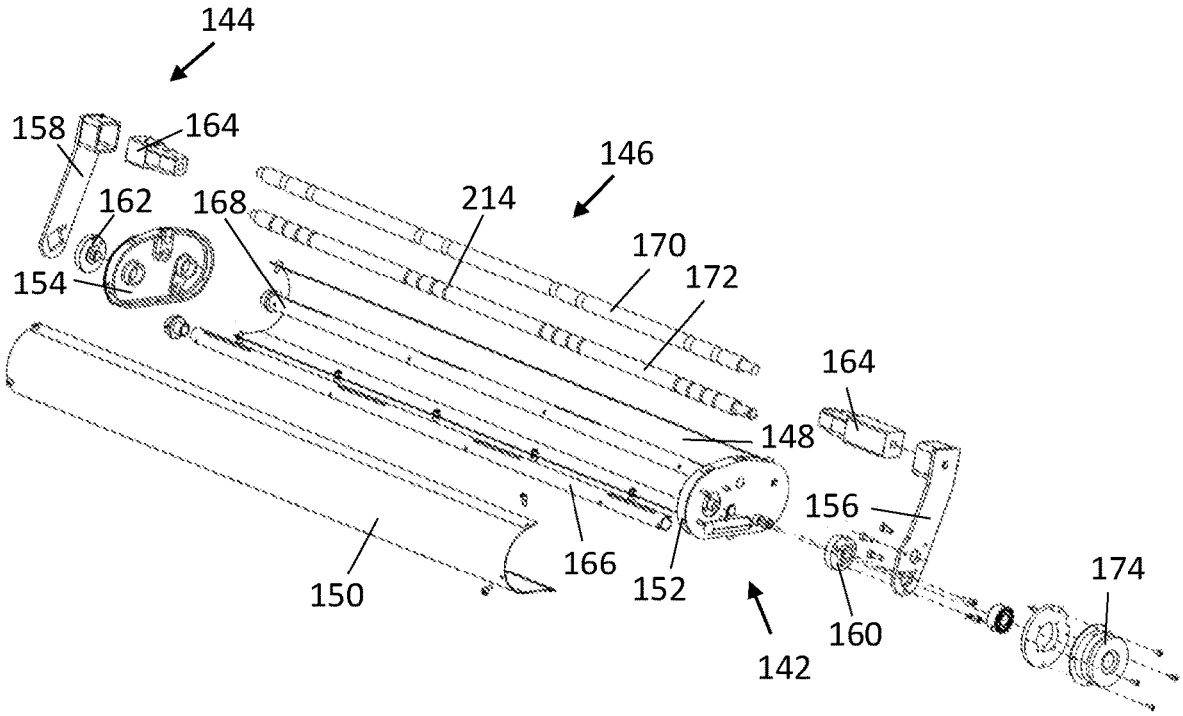
FIG. 5 illustrates an embodiment of a frame.

FIG. 5 illustrates an embodiment of the frame of the belt cleaner 110. The frame of the belt cleaner may comprise a housing 142 for the at least one cleaning member, at least one coupling member 144 for coupling the at least one cleaning member 108 to the body of the bowling pinsetter 106 and components 146 for operating the at least one cleaning member.

In some embodiment, the at least one cleaning member and the components for operating the at least one cleaning member are covered by the housing. The housing may comprise, for example, a first 148 and a second 150 side covers and a first 152 and a second 154 end plates. The first and second side covers and the first and second end plates are assembled together, for example, by screws to form the housing, which covers and protects the at least one cleaning member and other components. The housing may also be used for connecting the coupling and positioning members into the belt cleaner. Also the components for operating the at least one cleaning member may be supported and/or connected into the housing. The structure of the assembled housing may be open so that the at least one cleaning member may contact the at least one belt of the bowling pinsetter in the cleaning position.

In one embodiment, the coupling member may be in the both end of the belt cleaner for coupling the belt cleaner to the body of the bowling pinsetter. The coupling member may comprise a first coupling part 156, a second coupling part 158, a first bracket 160, a second bracket 162 and an adapter part 164. The coupling parts are connected to the brackets from first ends and the adapter part may be connected to second end. The first coupling part 156 may be connected to the first bracket 160 and the second coupling part 158 to the second bracket 162. The first bracket 160 may be connected to the first end plate 152 and the second bracket 162 to the second end plate 154 of the frame. The adapter part 164 may comprise two ends, a first end for connecting it to the coupling part and a second end for connecting the belt cleaner to the body of the bowling pinsetter. For example, there may be a hole in the body of the bowling pinsetter where the adapter part is connected. It is also possible to change the adapter part if it does not fit to connection interface of the bowling pinsetter. In other adapter part, the first end of the adapter part may be same to connect the adapter part to the coupling part but the second end, which is connected to the body of the bowling pinsetter, may be different. Therefore, the selection of the adapter part 164 may be done based on the connection interface of the body of the bowling pinsetter. In some embodiments, the connection of the second coupling part 158 to the second bracket 162 and the end plate 154 may be simple and easy to open because the end plate 154 may be occasionally removed for replacing the at least one cleaning member. This connection may be executed, for example, by one locking component which may be opened without any tools. Hence, only the one locking component needs to be opened to remove the second coupling part 158 from the second end plate 154.

In one embodiment, the components for operating the the belt cleaner may comprise a first 166 and a second axle 168, at least one support a support member 170, a rotation member 172 and control member 174. The first 166 and the second axle 168 may be used for mounting the at least one cleaning member to the belt cleaner. The support member 170 is for receiving the at least one cleaning member and the at least one belt of the bowling pinsetter in the cleaning position. The rotation member 172 is for rotating the at least one support member and the control member 174 is for limiting the rotation of the first axle.

Figure 6:
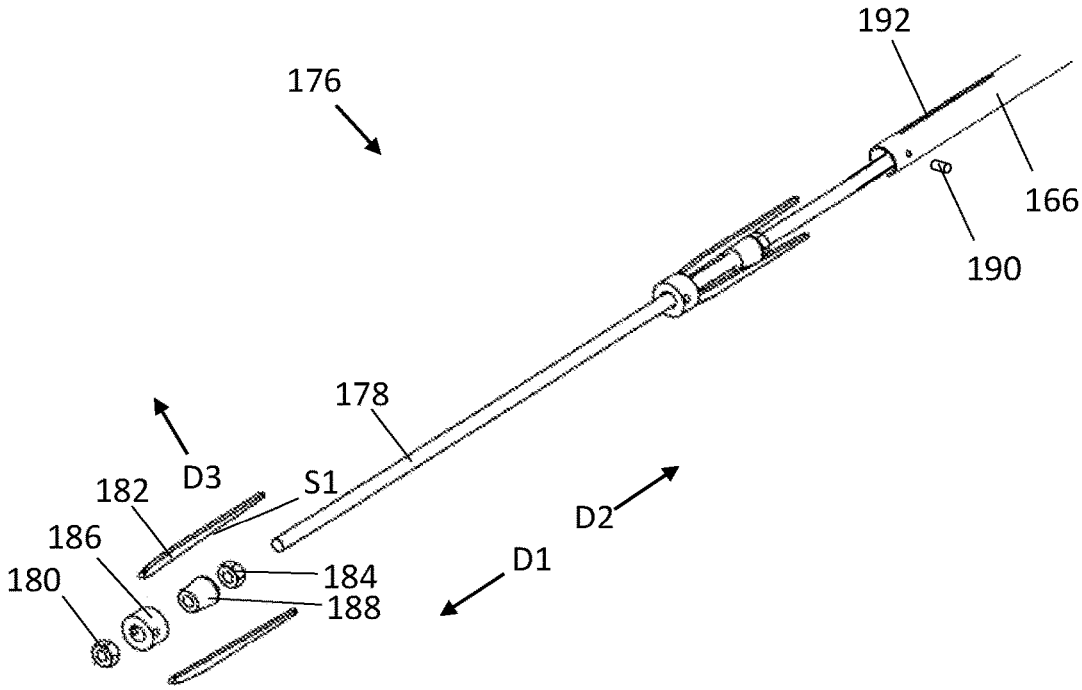
FIG. 6 illustrates an embodiment of a locking member.

In embodiments where the at least one cleaning member is the cloth roll, the clean unused cloth roll is mounted into the first axle and the dirty used cleaning cloth is rolled into the second axle. The first and the second axle are positioned in parallel with respect to one other and the both axles may have a pipe structure, in other words, the structure may be hollow. The first and/or second axle may further comprise at least one locking member 176 for locking the at least one cloth roll into the axle. FIG. 6 illustrates an embodiment of the locking member 176. The locking member may comprise at least a one set of common components and at least one set of locking components. There may be only one set of the common components in the one locking member, no matter how many cleaning members are used. An amount of the sets of the locking components used in the locking member may be relative to the amount of the cleaning members. For example, if four cleaning members are used, then four sets of the locking components may be used to lock the all four cleaning members. The common components may comprise a threaded bar 178 and a tightening nut 180. The locking components may comprise at least one locking wing 182, a locking nut 184, a bushing 186, a cone bushing 188 and a locking screw 190. The main function of the common components is to lock the locking components so that the locking components may lock the at least one cleaning member in its place. In some embodiments, a plurality of the locking components may be used for locking a one cleaning member. For example, if the cleaning member is wide it may be locked with more than one locking components to ensure the proper fixing.

In some embodiments, the locking member may be assembled inside the first and second axle, which structure may be hollow. The locking components may be assembled into the threaded bar. Operation of the locking components, in other words, using the locking components for locking the at least one cleaning member is carried out by rotating the tightening nut 180 which is in the other end of the threaded bar 178. The threaded bar goes freely through the bushing 186 which is locked inside the axle by the locking screw 190. The tightening nut 180 is against the bushing locked by the locking screw and when the tightening nut is tightened, the threaded bar 178 moves to the direction D1. If a plurality of locking components is used in the locking member, then the tightening nut 180 may be against the bushing which is the nearest to the other end of the axle. The locking wings 182, cone bushing 188 and locking nut 184 are assembled into the threaded bar 178 on the other side of the bushing 186 relative to the tightening nut. The locking nut 184 and cone bushing 188 may be placed under the at least one locking wing 182. The first and second axle may have holes 192 for the at least one locking wings so that the at least one locking wing may come partly through the hole. The cone bushing may move freely in the threaded bar. The locking nut prevents movement of the cone bushing to the direction D2 especially in case when the tightening nut 180 is tightened. As a result of the tightening, the tightening nut forces the cone bushing to move to the direction D1 because the threaded bar moves the direction D1 and movement of the cone bushing to the direction D2 is prevented by the locking nut 184.

The movement of the cone bushing to the direction D1 presses the at least one locking wing to direction D3 and hence, the locking wing moves partly through the hole 192 of the axle and contacts with the cleaning member. The structure of the at least one locking wing may prevent the locking wing dropping totally out of the hole 192, in other words, there may be stopper feature in the at least one locking wing to prevent the dropping. The locking wing 182 is connected also to the bushing 186 from the one end. Hence, the locking wing may come out so that it may lock the cleaning member without dropping out of the hole. The location of the at least one locking wing in the axles may be same as the location of the at least one cleaning member. Then the at least one locking wing comes partly through the axle in a spot where the at least one cleaning member is and locks the cleaning member. A surface S1 of the locking wing, which contacts with the cone bushing 188 may be chamfered so, that the movement of the cone bushing to the direction D1 may enhance the movement of the at least one locking wing 182 to the direction D3. Rotation of the tightening nut 180 to the untightening direction, which is opposite to the tightening direction, enables the threaded bar to move to the direction D2. It also enables the movement of the cone bushing to the direction D2 and hence the locking wing 182 may not contact anymore to the at least one cleaning member. The cleaning member may then be removed from the axle because the locking wing may not lock the cleaning member in its place anymore.

In some embodiments, the at least one clean cloth roll is locked to the first axle 166 by the locking member 176 and the clean cloth is conveyed over the support member 170 and locked into the second axle 168 by the locking member. The first and second axle may be detachable mounted into the frame 110 for easy replacement of the at least one cleaning member. Removal of the belt cleaner from the body of the bowling pinsetter may not be needed during the replacement of the at least one cleaning member. The axles may be removed from the frame when the second end plate 154 of the housing is removed. When the second plate is removed, the second coupling member may also be removed and hence there may be some extra support element which is used during the replacement of the cleaning members. The extra support element may be used to support the belt cleaner when the second coupling member is not in use. The at least one cleaning member may be removed or assembled to the axles when the axles are out of the frame. This structure enables easy mounting and replacement of the cleaning members. In some embodiments, a plurality of the cleaning members are assembled to the axles adjacent to each other, this enables cleaning of numerous belts of the bowling pinsetter at the same time. The location of the cleaning members in the axles may be positioned according to the locations of the belts of the bowling pinsetter so, that the all cleaning members may contact the belts properly.

In some embodiments, the components for using the at least one cleaning member may comprise the support member 170. The cloth, which comes from the cloth roll assembled to the first axle and goes to the second axle, may be routed over the support member, hence, the support member may be located under the cloth. When the rotation member 172 rotates the support member 170, the rotation of the support member pulls the clean cloth from the cloth roll assembled in the first axle. The loose dirty cloth is rolled to the second axle. It is also possible to use some element between the support member and the cloth to enhance the contact between them and, hence enhance the pulling of the clean cloth from the first axle. The support member also supports the cloth during the cleaning process. In other words, the clean cloth is pressed against the belts with the support member which is under the cloth. The cloth for cleaning the belts is between the support member and the belts.

Figure 9A:
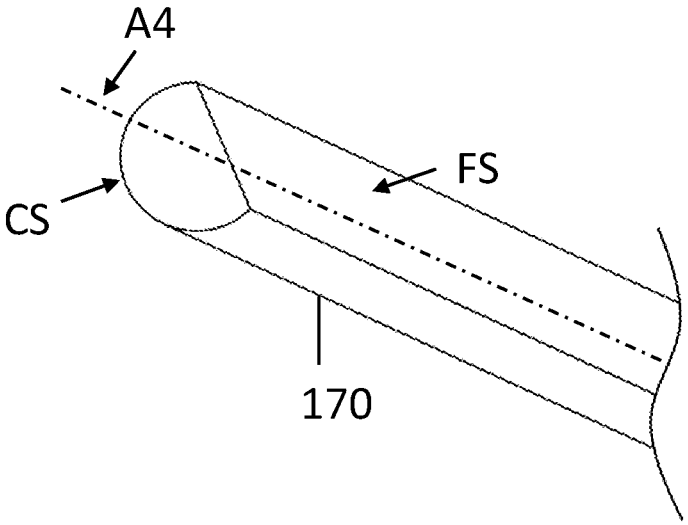
FIGS. 9A, 9B and 9C illustrate embodiments of the support member.
Figure 9B:
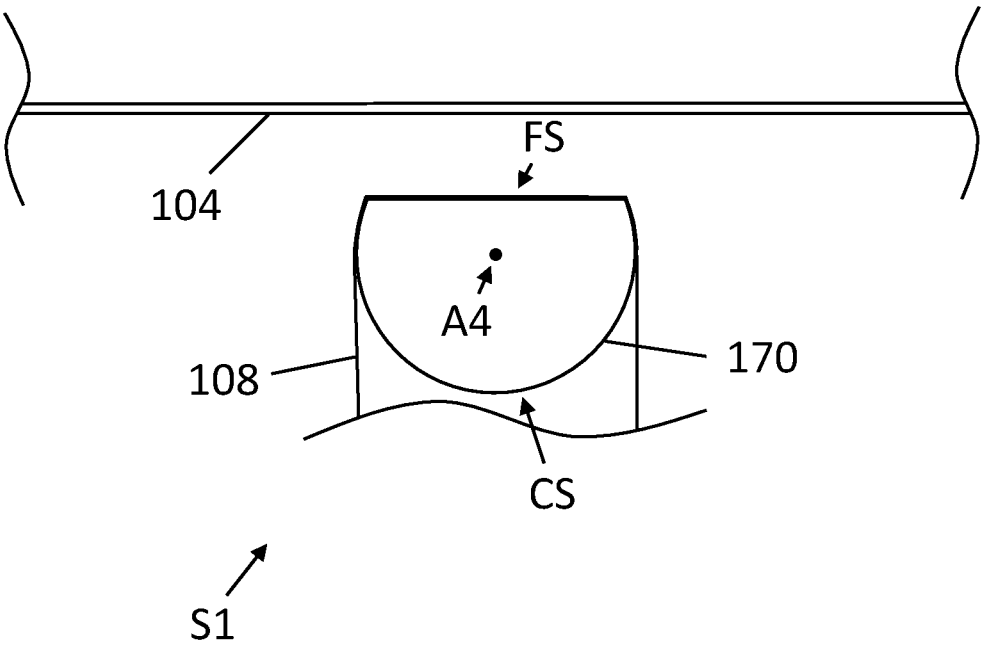
Figure 9C:
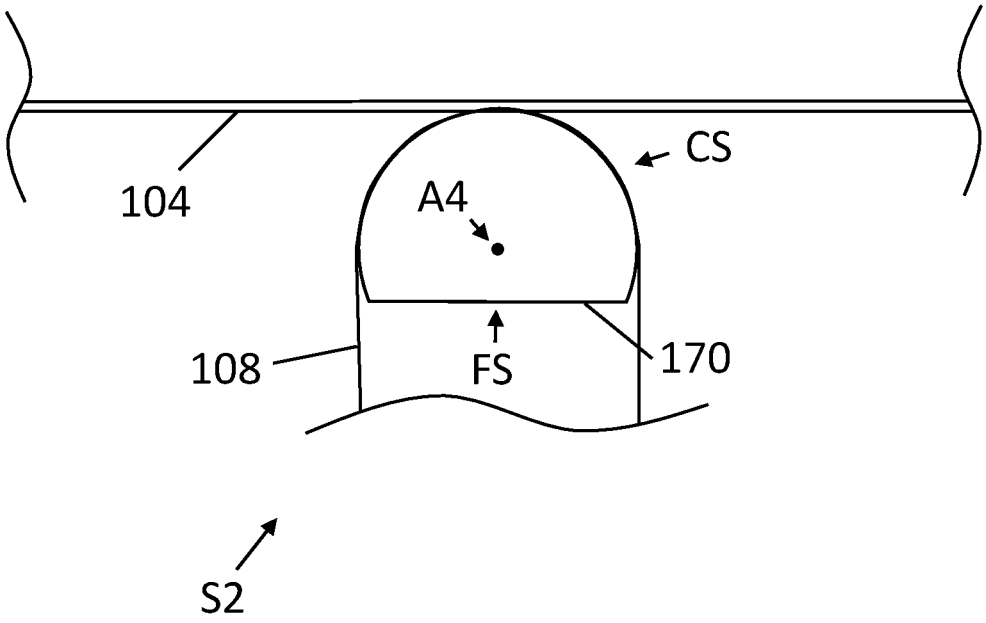

In an embodiment, the support member is rotatable over its longitudinal axle between a first state and a second state, wherein in the first state the cleaning member is in the non-cleaning position and in the second state the cleaning member is in the cleaning position. FIG. 9A, illustrates an embodiment wherein a cross section of the support member 170 is substantially a half circle, wherein the support member 170 has a flat side FS and a circle side CS. FIGS. 9B and 9C illustrate the first state 51 and the second state S2 of the support member 170. The state of the support member 170 may be changed by rotating the support member 170 over its longitudinal axle A4. The rotational movement of the support member 170 may then cause a movement of the cleaning member 108 between the cleaning and non-cleaning positions. The rotational movement of the support member 170 may also guide the cleaning member 108 into the right position in relation to the belt 104 when the cleaning member 108 is set to the cleaning position.

In the first state S1, the flat side FS is towards the belt of the bowling pinsetter 104 and in the second state S2 the circle side CS is towards the belt 104. When the flat side FS is turned towards the belt of the bowling pinsetter 104, the cleaning member 108 is in the non-cleaning position and when the circle side CS is turned towards the belt of the bowling pinsetter 104, the cleaning member 108 is in the cleaning position. In other words, the cleaning member may not be in contact with the belt when the flat side is towards the belt and respectively, the cleaning member may be in contact with the belt when the circle side is towards the belt. In some embodiment, the shape of the cross section of the support member may also be some other than the half circle. It may be anything that enables same effect like the half circle described above. The cleaning member may be, for example, the cloth roll, wherein the cleaning cloth is set over the support member. In an embodiment, the cleaning cloth may not be in contact with the support member in the first state, when the flat side is substantially towards the belt and cleaning cloth.

In an embodiment, the rotating member coupled with the mechanism rotates the support member between the first and second state. In another embodiment, the support member is coupled with the positioning member such that the positioning member directly rotates the support member. The positioning member may comprise the mechanism that rotates the support member.

In one embodiment the support member may be a bar which cross-section may be, for example, substantially round. The support member may be pipe or solid bar, it may also some other profile suitable for supporting. In an embodiment, the support member is located in U-shaped grooves, which may be on the top of the end plates of the frame. The support member may be removed from the U-shaped grooves and placed back to the U-shaped grooves without dismantling the frame of the belt cleaner. This structure make easier the replacement of the at least one cleaning member. The support member may be locked to the U-shaped grooves of the end plates with some locking component. For example, a steel ball which is pressed against the end plate by a spring, may be used. The spring and the steel ball may be placed inside the support member so that the spring pushes the ball out of the open end of the support member. The ball touch the end plate where may be some feature for the ball, for example, a cavity and this locks the support member to the grooves of the end plate.

In some embodiments, the support member may comprise at least one groove 194 for the at least one belts of the bowling pinsetter. The groove may enhance the cleaning of the belt when the belt, which shape is substantially round or nearby the round. This is important because it is possible that side portion of the belt touches the object which is laying on it and which is transported by the belt. Size of the groove may be dimensioned so that the substantially round shaped belt fits into the groove and side portions of the groove clean also the side portions of the belt. With the at least one groove in the support member, area of the cleaned belt is greater compared to the support member without the grooves. Locations of the at least one groove may be dimensioned according to the belt of the bowling pinsetter. When the location of the at least one groove is accordant with the belt, the belt may go directly into the groove when the belt cleaner is positioned into the cleaning positions. The at least one groove is dimensioned so that the belt does not stick to the groove and hence, the belt leaves easily away from the groove when the belt cleaner is positioned to the non-cleaning position.

Figure 7:
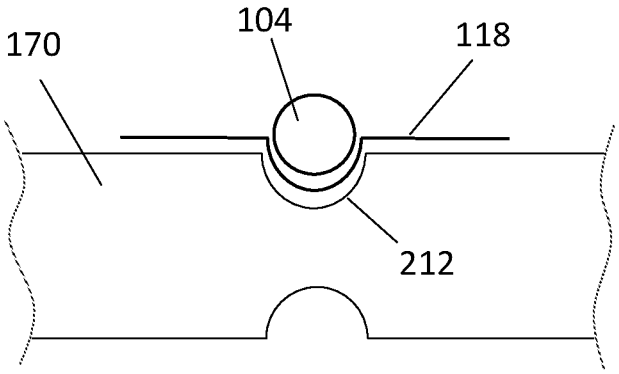
FIG. 7 illustrates an embodiment of a support member with a groove.

FIG. 7 illustrates a cross-section view of the support member 170, the groove of the support member 212, the cleaning cloth 118 and the belt of the bowling pinsetter 104.

In embodiment wherein the support member and the groove on the support member are used, the cloth from the cloth roll goes into the groove when the support member is pressed against the belt. In other words, FIG. 7 illustrates the situation wherein the belt cleaner is positioned to the cleaning position and the at least one cleaning member, in this embodiment cloth roll, is connected with the belt. The support member presses the cloth against the belt and the belt presses the cloth into the groove of the support member. Then, the cloth forms according to the shape of the groove. Hence, the cloth in the side portions of the groove contacts with the side portion of the belt and this enables greater cleaning area.

The embodiment wherein the at least one groove is used in the support member, may also be used for wider belt as well which does not fit into the groove. In this kind of embodiment, the wider cloth roll may be applier for the wider belt. The belt may not go into the groove and may not press the cloth into the groove either. This is not a problem because a shape of the wider belt is substantially rectangle and when objects are laying on it and are transported by the belt, only a top surface of the belt touches the object. Therefore in the embodiment wherein the wider belts are cleaned by the belt cleaner there is no need for cleaning the side portions of the wider belt, only the top surface. Hence, the belt cleaner works without problems also for the wider belts which does not fit into the groove of the support member.

In one embodiment, the components for operating the cleaning members may comprise the rotation member 172 for rotating the support member 170. The rotation member may be a solid bar or pipe or some other profile suitable for rotating. The rotation part may be connected to the mechanism from one end, which provide a force for rotating the rotation member. The rotation member may be connected to the cogwheel of the mechanism, which is used for transmitting the rotation force from the mechanism to the rotation member. The rotation member and support member may be positioned in parallel with respect to one another. The rotation member may be placed so close to the support members that when the rotation member rotates about its longitudinal axle it also rotates the support member about its longitudinal axle. The rotation member may further comprise at least one friction element 214 which provide a friction between the rotation member and support member to enhance the contact between them. In some embodiments, the friction element may be, for example, at least one O-ring. The O-ring may be placed around the rotation member so that it also contacts the support member.

In some embodiments, the component for operating the cleaning members may comprise the control member 174. The control member may be used for limiting the rotation of the first axle wherein the clean cloth roll is assembled. The control member may comprise a magnet brake. The control member may further comprise a bracket part and a bearing for the magnet brake. The control member may be used according to the need to limit the rotation of the first axle. The control member 174 may be located inside or outside of the frame 110 and it is connected to the other end of the first axle. For example, if the rotation movement of the first axle and the cleaning member in the axle need to be limited, the controlling member may be used. This may limit the rotation movement or prevent it totally. When the controlling member is not used, the first axle and the cleaning member in the first axle may rotate freely. In some embodiments, the control member is used for preventing the rotation of the first axle and the cleaning member locked in the first axle, when the second axle rotates and rolls the loose used cloth. The control member ensures that the rotation of the second axle does not pull the clean cloth from the first axle. Then, the rotation of the second axle just rolls away the loose dirty cloth.

Figure 8:
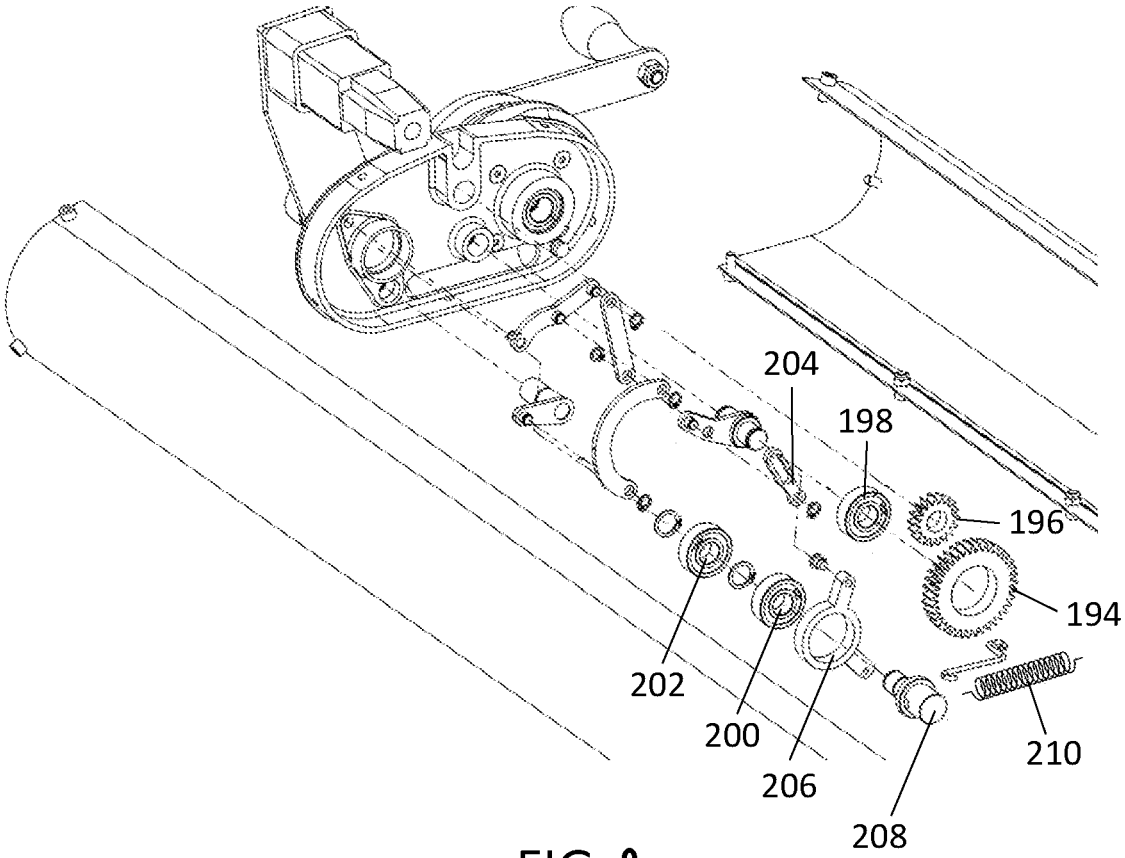
FIG. 8 illustrates an embodiment of the positioning member.

FIG. 8 illustrates one embodiment wherein the mechanism 120 is further used for rotating the first and the second axle. The mechanism 120 may further comprise a second cogwheel 194, a third cogwheel 196, a first one-way bearing 198, a second one-way bearing 200, a third one-way bearing 202, a fifth actuating part 204, a sixth actuating part 206, a spindle 208 and a spring 210. The purpose of these components is to transmit the movement from the mechanism and rotate the first and/or the second axle. The first one-way bearing 198 may be assembled inside the second cogwheel 194 and to the other end of the fourth actuating part 140. Then rotation movement of the fourth actuating part affects also to the first one-way bearing. The first one-way bearing works as a normal bearing when it is rotated to a first direction and hence it does not transmit the rotational movement to the second cogwheel. When the first one-way bearing is rotated to the opposite direction, its bearing-like rotation is locked and hence it transmits the rotational movement to the second cogwheel. The second cogwheel is placed nearby the third cogwheel so that the rotation of the second cogwheel rotates the third cogwheel, which may be mounted to the rotation member and hence it may provide a rotational movement for the rotation member.

A first end of the fifth actuating part 204 is connected to the arm of the fourth actuating part 140 and a second end, where is a rectangle shaped hole with rounded ends, is connected to the sixth actuating part 206. The sixth actuating part may comprise a ring-shaped structure comprising two arms. A first arm is connected to the fifth actuating part 204 and second arm to the spring 210. The second one-way bearing 200 is assembled inside the sixth actuating part 206 and the spindle 208 inside the second one-way bearing 200. The third one-way bearing 202 is assembled to a first end of the spindle, next to the second one-way bearing 200 which is connected inside the sixth actuating part 206. There may be a bearing housing in the first end plate 152 for the third one-way bearing 202, so the third one-way bearing may be connected to the first end plate. This connects also the spindle 208, the second one-way bearing 200 and the sixth actuating part 206 to the first end plate 152 because all of these parts are connected with the third one-way bearing. When the fourth actuating part 140 is rotated it transmits the movement to the fifth actuating part 204 because it is connected to the arm of the fourth actuating part. The fifth actuating part 204 is connected to first arm of the sixth actuating part 206 and movement of the fifth actuating part rotates the sixth actuating part about its central axle. This rotational movement is transmitted to the spindle 208 via the second one-way bearing 200. The second end of the spindle which is not inside the third one-way bearing, is connected to the second axle 168 providing the rotational movement for the second axle. The second one-way bearing transmits the rotational movement to the sixth actuating part only to one rotation direction and hence, it works like the first one-way bearing, which was described earlier. The third one-way bearing works also like the first and the second one-way bearing transmitting the rotational movement only to the one rotational direction. The second and the third one-way bearing may be assembled so that the second one-way bearing transmits movement to one direction and the third one-way bearing transmits movement to the opposite direction. First end of the spring 210 is connected to the second arm of the sixth actuating part 206 and second end of the spring is connected to the first end plate 152. A function of the spring is to rotate the sixth actuating part about its central axle when the fifth actuating part does not affect the sixth actuating part. The fifth actuating part affects, in other words rotates, the sixth actuating part when the belt cleaner is moving to the cleaning position. When the belt cleaner is moving to the non-cleaning position, the fifth actuating part may not affect the sixth actuating part and hence the spring rotates the sixth actuating part to opposite direction than the sixth actuating part.

In one embodiment the mechanism may directly rotate the first axle, in other words, the mechanics may directly be connected to the first axle. Then, for example, the separate rotation member is not needed for rotating the first axle. It is also possible that rotation of the second axle pulls the clean cloth from the cloth roll assembled in the first axle and hence, the second axle may provide the rotational movement for the first axle.

In some embodiments, the parts of the mechanism which are connected together may be connected with a pin-hole connection. The pin may be separate component or integral feature of the part. First part may comprise the pin that is connected to the hole of the other part and this connection may be ensured, for example, by a retaining ring or similar locking component. It is also possible that other components like, for example, rivets or screws may be used for connecting the parts together. Other components described in this application like bearings and cogwheels may also be locked by the retaining ring or similar locking components.

Generally, all parts included in the belt cleaner assembly may be connected together by screws, bolts, nuts, rivet, glue or any other locking components which are suitable for connecting the parts together. In some embodiments, the all or some of the different locking components may be mixed in the same assembly to achieve the desired result.

In one embodiment, the mechanism 134 may provide movement force for positioning the belt cleaner to the cleaning position and/or the non-cleaning position and at the same time for rotating the cleaning members. The rotation of the cleaning members enables that there is always the clean unused cloth available for cleaning the belts, when the belt cleaner is connected to the cleaning position. When the belt cleaner is moving to the non-cleaning position, the mechanism rotates the rotation member which transmits the rotational movement for the support member. Rotation of the support member pulls the clean cloth from the cloth roll assembled in the first axle. When the belt cleaner is moving to the cleaning position, the mechanism rotates the second axle so that the loose used dirty cloth is rolled to the second axle. Then, the control member prevents the rotation of the first axle and hence, prevent pulling of the clean cloth from the cloth roll assembled in the first axle.

In some embodiments, the belt cleaner may comprise a plurality of the cleaning members adjacent to each other. When the belt cleaner is in the cleaning position it may clean a plurality of the belts simultaneously which makes the cleaning process very effective compared to a traditional method wherein the belts are cleaned one by one with the cloth. Especially in bowling alleys where may have dozens of bowling pinsetters and the every bowling pinsetter has a plurality of belts which must be cleaned from dirt. Positions of the cleaning members may be relative to the positions of the belts, which ensure that the all cleaning members contact the belts during the cleaning process.

In one embodiment, the apparatus may be an auxiliary device like the separate belt cleaner for cleaning the belts of the pinsetter. The separate belt cleaner may be assembled to the bowling pinsetter, for example, in manufacturing phase of the bowling pinsetter or later, when the bowling pinsetter is already delivered to an end user. Therefore, the belt cleaner may be added to the existing bowling pinsetter afterwards when the belt cleaner is needed. This make possible to update the existing bowling pinsetters and to add the belt cleaner also for the older bowling pinsetters which are already in use. Alternatively, some part of the belt cleaner may be integrated to the bowling pinsetter already in the manufacturing phase, for example, a connection interface. Another part, for example, the actual belt cleaner with the at least one cleaning member may be added to the integrated connection interface later. In some other embodiments, the apparatus may be the bowling pinsetter wherein a system for cleaning the belts, in other words, the belt cleaner is an integral part of the bowling pinsetter. Then the belt cleaner is not the separate auxiliary device but the integral part of the bowling pinsetter. The integration of the belt cleaner to the bowling pinsetter may be done already in the manufacturing phase of the bowling pinsetter.

It will be obvious to a person skilled in the art that, as the technology advances, the inventive concept can be implemented in various ways. The invention and its embodiments are not limited to the examples described above but may vary within the scope of the claims.

The invention claimed is:

1. An apparatus, comprising:

at least one cleaning member for cleaning at least one belt of a bowling pinsetter;

a frame for coupling the at least one cleaning member to the bowling pinsetter; and at least one positioning member comprising a mechanism coupled with an electric motor configured to provide force to move and guide the at least one cleaning member between a cleaning position in which the at least one cleaning member contacts the at least one belt and a non-cleaning position in which the at least one cleaning member does not contact the at least one belt, wherein the cleaning member is coupled with the bowling pinsetter in the cleaning position and in the non-cleaning position.

2. The apparatus according to claim 1, wherein the positioning member is configured to provide a translational and/or a rotational movement for moving and guiding the at least one cleaning member between the cleaning position and the non-cleaning position.

3. The apparatus according to claim 1, wherein the frame comprises a housing for the at least one cleaning member and wherein a structure of the housing is open so that the at least one cleaning member contacts the at least one belt of the bowling pinsetter in the cleaning position.

4. The apparatus according to claim 1, wherein the frame comprises a first and a second axle for the at least one cleaning member.

5. The apparatus according to claim 4, wherein the at least one of the first and the second axle comprises at least one locking member for locking the at least one cleaning member to the at least one of the first and the second axle.

6. The apparatus according to claim 4, wherein the first and/or the second axle is detachably mounted into the frame for replacement of the at least one cleaning member.

7. The apparatus according to claim 1, wherein the at least one cleaning member comprises a plurality of the cleaning members mounted into the same axle adjacent to each other.

8. The apparatus according to claim 1, wherein the frame comprises a support member configured to receive the at least one cleaning member and the at least one belt in the cleaning position.

9. An apparatus, comprising:

at least one cleaning member for cleaning at least one belt of a bowling pinsetter;

a frame for coupling the at least one cleaning member to the bowling pinsetter; and at least one positioning member comprising a mechanism configured to move and guide the at least one cleaning member between a cleaning position in which the at least one cleaning member contacts the at least one belt and a non-cleaning position in which the at least one cleaning member does not contact the at least one belt, wherein the cleaning member is coupled with the bowling pinsetter in the cleaning position and in the non-cleaning position, wherein the frame comprises a control member configured to limit rotation of the first axle.

10. An apparatus, comprising:

at least one cleaning member for cleaning at least one belt of a bowling pinsetter;

a frame for coupling the at least one cleaning member to the bowling pinsetter; and at least one positioning member comprising a mechanism configured to move and guide the at least one cleaning member between a cleaning position in which the at least one cleaning member contacts the at least one belt and a non-cleaning position in which the at least one cleaning member does not contact the at least one belt, wherein the cleaning member is coupled with the bowling pinsetter in the cleaning position and in the non-cleaning position, wherein the at least one positioning member is configured to rotate the first axle during the positioning of the at least one cleaning member to the non-cleaning position and is configured to rotate the second axle during the positioning of the at least one cleaning member to the cleaning position.

11. The apparatus according to claim 1, wherein the apparatus comprises a plurality of the cleaning members for cleaning a plurality of the belts of the bowling pinsetter simultaneously.

12. The apparatus according to claim 1, wherein the apparatus is an auxiliary device for the bowling pinsetter.

13. The apparatus according to claim 1, wherein the apparatus is the bowling pinsetter.

* * * * *